US007507266B2

(12) United States Patent
Steer

(10) Patent No.: US 7,507,266 B2
(45) Date of Patent: Mar. 24, 2009

(54) METHOD FOR OBTAINING COMBUSTION GASES OF HIGH CALORIFIC VALUE

(76) Inventor: Thomas Steer, Jahnstrasse 8, 85356 Freising (DE)

( * ) Notice: Subject to any disclaimer, the term of this patent is extended or adjusted under 35 U.S.C. 154(b) by 0 days.

(21) Appl. No.: 11/482,626

(22) Filed: Jul. 7, 2006

(65) Prior Publication Data

US 2006/0265955 A1 Nov. 30, 2006

Related U.S. Application Data

(60) Division of application No. 11/060,322, filed on Feb. 18, 2005, now Pat. No. 7,094,264, which is a continuation of application No. 10/116,038, filed on Apr. 5, 2002, now abandoned.

(30) Foreign Application Priority Data

Oct. 7, 1999 (DE) ..... 199 48 332

(51) Int. Cl.
*C10J 3/46* (2006.01)
*C10J 3/00* (2006.01)

(52) U.S. Cl. ..... 48/197 R; 48/209; 48/210

(58) Field of Classification Search ..... 48/61, 48/62 R, 71–73, 78, 89, 98–101, 105, 102 A, 48/111, 119, 120, 123, 200–202, 209–210, 48/197 FM; 422/139, 141, 144–147, 184.1, 422/185, 188, 223, 200–201, 204–205, 232–236
See application file for complete search history.

(56) References Cited

U.S. PATENT DOCUMENTS 2,560,356 A * 7/1951 Liedholm ..... 208/150
2,588,075 A * 3/1952 Barr et al. ..... 48/202
2,591,595 A * 4/1952 Ogorzaly ..... 48/203
4,249,472 A * 2/1981 Mitchell ..... 110/245
5,059,404 A * 10/1991 Mansour et al. ..... 48/202

FOREIGN PATENT DOCUMENTS

WO WO 0077128 A1 * 12/2000

* cited by examiner

*Primary Examiner*—Glenn Caldarola
*Assistant Examiner*—Randy Boyer
(74) *Attorney, Agent, or Firm*—Lawrence E. Laubscher, Sr.; Lawrence E. Laubscher, Jr.

(57) ABSTRACT

The present invention relates to a method for obtaining combustion gases of high calorific value, wherein carbonaceous materials are allotermically gasified in a fluidized layer containing solid particles, using a gaseous gasifying agent and by supply of heat, and the gases thus produced are separated from the solid particles and withdrawn. Said method is characterized in that the solid particles are indirectly heated in a first descending bed and supplied to a second ascending fluidized bed in which the fluidized layer is formed and gasification takes place for the greatest part. The method further relates to an apparatus for performing said method.

9 Claims, 2 Drawing Sheets

METHOD FOR OBTAINING COMBUSTION GASES OF HIGH CALORIFIC VALUE

CROSS-REFERENCE TO RELATED APPLICATION

This application is a division of application Ser. No. 11/060,322 filed Feb. 18, 2005 (now U.S. Pat. No. 7,094,264), which in turn was a continuation of parent application Ser. No. 10/116,038 filed Apr. 5, 2002 (now abandoned).

BACKGROUND OF THE INVENTION

1. Field of the Invention

The present invention relates to a method for obtaining combustion gases of high calorific value.

2. Description of Related Art

Careful use of resources becomes more and more the central objective of society. Energy generation from waste materials and regenerative substances such as biogenic fuels during first or consecutive use is thus of special importance. Furthermore, towards the end of the $20^{th}$ century the generation of hydrogen becomes more and more the center of interest, not least due to the beginning exploitation of hydrogen in fuel cells.

The energetic exploitation of solid, paste-like or liquid fuels is most of the time carried out by way of combustion with subsequent use of the previously chemically bound heat released during combustion.

Apart from this, there have been approaches for a long time to establish gasification processes for generating combustion gases of high calorific value from solid, paste-like or liquid fuels. The combustible part of the crude gas during each gasification consists for the greatest part of hydrogen and carbon monoxide; smaller amounts are methane ad higher hydrocarbons. Each type of gasification thus generates hydrogen.

An essential advantage of gasification over combustion is that the pollutants contained in the starting substance are converted in a reducing atmosphere into constituents or into relatively simple chemical compounds. The gas volumes are considerably smaller in comparison with combustion, so that gas purification in the case of gasification can be carried out more easily and at lower costs as compared to combustion when the objective is the same.

There are three basic types of gasification methods:

1. Gasification of solid, paste-like or liquid fuels with the gasification medium air is in technical terms the simplest method and leads to partial oxidation. The calorific value of the gas produced thereby is lower than that of the fuel used. The gasification temperatures are typically within the range of 600° C. to 900° C. Tars are produced at said temperatures to a considerable extent. A large-scale use of the method has so far not been possible because so far the removal of tars from the gas could not be sufficiently controlled technically for small gasifiers.
2. Like air gasification, the gasification of solid, paste-like or liquid fuels with the gasification medium oxygen results in partial oxidation with a decrease in the calorific value. The gasification temperatures are typically at 1600° C. so that the formation of tar is ruled out. A large-scale use has so far not been possible because the generation of the necessary oxygen entails high costs and excessively burdens economic calculations in industry. In comparison with air gasification, oxygen gasification leads to smaller gas amounts because the gasification medium does not introduce an inert nitrogen amount 3. The gasification of solid, past-like or liquid fuels with the gasification medium steam leads to a gas of a higher calorific value than the fuel used originally. Therefore, heat must be supplied to the gasification reactor from the outside. The gasification temperatures are typically between 600° and 900° C. Tar might be formed. However, its potential is lower than in air gasification. A large-scale use has so far not been possible because the problem of heat input into the reactor has, in particular, not been solved in a satisfactory way. The gas amounts of the steam gasification lie between those of air and oxygen gasification. This is due to the fact that during steam gasification the carbon of the fuel is oxidized by the oxygen of the steam into carbon monoxide or carbon dioxide, whereby additional hydrogen is formed. The potential of the steam gasification to generate hydrogen is thus considerably higher than that of air or oxygen gasification.

Gasification methods in which the reaction heat needed is supplied by partial oxidation are called autothermic, whereas those in which the reaction heat needed is supplied from the outside are called allothermic.

The allothermic steam gasification of solid, paste-like or liquid fuels normally takes place in a fluidized bed for ensuring uniform reaction conditions. In this process, steam flows from below to a bed of small solid particles. The inflow rate is here so high that the solid particles are at least kept suspended. One talks about a stationary fluidized bed when the solid particles form a fixedly defined surface with ascending gas bubbles, whereas in a circulating fluidized bed the main part of the solid particles is discharged with the gas flow from the fluidized bed reactor and is separated from the gas flow and then supplied again via a down path to the lower part of the fluidized bed reactor proper. The solid particles may be inert, consisting e.g. of quart sand, limestone, dolomite, corundium, or the like, but they may also consist of the ash of the fuel. The solid particles can accelerate the gasification reactions due to catalytic properties.

The Nack et al U.S. Pat. No. 4,154,581 describes a gas generator comprising two reaction zones and having an exothermic reaction environment in the heating portion, so that heat is directly provided. Heat transportation is ensured by using bed material of different grain sizes. A coarse-grained material remains in the exothermic bed, whereas a fine-grained fraction travels from the exothermic into the endothermic region and back. The fine-grained fraction assumes the function of heat transfer.

Said method has the drawback that the transportation of the solids between the beds must coincide with the heat balance of the beds, which makes great demands on the control units at high working temperatures and different load conditions. Furthermore, as far as the fuels are concerned, there is no Separation between the combustion region and the gasification region, so that possible pollutants from the fuel may be found along both the gasification path and the combustion path, which complicates the gas cleaning system.

It is known from the European patent No. EP 0 329 673 and the U.S. Patent to Mansaur et al U.S. Pat. No. 5,059,404 that heat input is realized with the help of heat exchangers which are provided in the fluidized bed, i.e. in the reaction zone. The drawback of such a concept is that the arrangement of the heat exchangers in the reaction zone predetermines the dimension of the reaction zone and the fluidized bed, respectively, because of the heat exchange surfaces required. Moreover, the heat exchange surfaces are directly exposed to the corrosive effects of harmful constituents of the fuel, which makes extreme demands on the material at surface temperatures of from 600° C. to more than 900° C. Finally, a combination of autothermic and allothermic methods is known from the German patent No. DE 197 36 867 A1. The necessary reaction heat is here supplied via hot steam and flue gases from a partial combustion of the product gas.

The combination of an autothermic and allothermic method has the effect that the gas amount increases considerably due to the nitrogen amount which is supplied with the air for partial combustion. Thus the partial pressures of the industrial gases decease, which has a negative effect on the subsequent gas cleaning and the after treatment of the gas.

A fluidized bed constitutes a technology which has been tried and tested and often employed for many years. Applications are e.g. the drying and burning of solid materials or of slurries. The basis for each fluidized bed method is a reactor in which a solids content is loosened by inflow from below to such an extent that the individual particles start to float in air, with the solids content being fluidized.

A distinction is made between two coarse types: When a solid surface of the fluidized solids content is formed, one talks about a stationary fluidized bed. When the particles are discharged with the gas flow from the reactor, one talks about a circulating fluidized bed. Further essential feats of every circulating fluidized bed are an apparatus for separating the discharged solid particles from the gas flow and a further means for returning the separated solid particles into the reactor.

In the course of time many constructional forms have been used for both basic types in the attempt to avoid the drawbacks of the one type and to exploit the benefits of the other.

The following documents should be mentioned by way of example:

DE 28 36 531: A stationary fluidized bed method in which regions of different fluidization are formed by installing a partition, so that bed material is circulated in a stationary bed.

EP 0 302 849: A circulating fluidized bed which develops DE 28 36 531, but rather reminds of a stationary than a circulating fluidized bed because of its constructional size.

DE 33 20 049. A stationary fluidized bed method in which bed material is circulatd due to different bed heights.

SUMMARY OF THE INVENTION

It is an object of the present invention to ice a mood for obtaining combustion gases of high calorific value for eliminating the above-mentioned problems at least in part.

Advantageously, there is no heating means in the reaction chamber in the method according to the invention and in the apparatus according to the invention. Corrosion problems that have so far existed are thereby avoided. Moreover, the inventive method and the inventive apparatus are not limited to special heating means, but it the use of any desired heating means, in particular tubular heat exchangers. Advantageously, no fuel particles pass from the reducing zone into an oxidizing zone. Moreover, the reaction chamber can be designed independently of the geometrical dimensions predetermined for the heating means, so that the constructional size of the apparatus according to the invention can be optimized.

In a preferred embodiment of the method of the invention, the first descending bed is loosened or slightly fluidized by injecting a gas; advantageously, this prevents an undesired agglomeration of the solid particles and is conducive to the transportation of the bed material. In another embodiment, the first descending bed is indirectly heated with the help of a heat exchanger which has a heating medium flowing therethrough. The heating medium may here flow in pulsating fashion in the beat exchanger upon beat emission to the first descending bed. Heat transfer from the heat exchanger to the first descending bed is thereby improved.

Furthermore, gasification may take place under pressure or under atmospheric conditions. The carbonaceous materials may consist of liquid, paste-like or solid materials, in particular of coke, crude oil, biomass or waste materials. Thus, the method according to the invention advantageously permits the processing of the most different carbonaceous materials. In a further preferred embodiment of the method according to the invention, steam is used as the gasifying agent In a preferred first embodiment of the apparatus according to the invention, the heating zone and the reaction zone may be separated by way of different fluidization of the fluidized bed, the different fluidization effecting a circulation of the bed material about one or several substantially horizontal axes. The substantially horizontal axes may be closed in the form of a ring. Said embodiment of the apparatus according to the invention is particularly characterized by a compact construction. In a second embodiment of the apparatus according to the invention, the heating zone and the reaction zone are separate by a wall. Moreover, the heating zone and the reaction zone may each be formed in a separate reactor. These two embodiments offer the advantage of a reliable separation of the heating zone from the reaction zone by constructional measures. The means for transferring the heated solid particles may be a wall opening or a pipe. Furthermore, said means for transferring the heated solid particles may be provided in a lower region of the heating zone. In a preferred embodiment, said means comprises a nozzle bottom with the help of which the solid particles can be slightly fluidized in the heating zone.

In a preferred embodiment of the apparatus according to the invention, the indirect heat supply means is at least one heat exchanger through which a heating medium can flow and which is provided in or at the heating zone. The use of heat exchangers as heat supply means simplifies the construction of the reactor. Moreover, the heat exchanger may comprise at least one resonant tube in which the heating medium flows in pulsating fashion upon heat emission to the heating zone. Advantageously, the heat transfer from the heat exchanger to the heating zone is thereby improved. The resonant tube may be connected to a combustion chamber for resonance generation. The generation of the desired resonance may also be achieved with the help of an acoustic resonator which is arranged such that it is separated from the combustion chamber.

In another embodiment, the means for producing the ascending fluidized bed is a nozzle bottom provided in a lower portion of the reaction zone. Such a nozzle bottom offers the advantage of a uniform injection of the fluidizing medium into the reaction zone.

The means for separating the gases produced during gasification from the solid particles may be a cyclone. In another preferred embodiment the separating means comprises baffles for producing a sharp deflection of the gas flow, whereby the gas flow and the solid particle flow are separated; the baffles are here followed by a channel for gas discharge and by the heating zone. Furthermore, a means for transferring the solid particles from the reaction zone into the heating zone may be provided for circulating the solid particles. Said means may be a wall opening or a pipe. Preferably, said means is provided in an upper portion of the reaction zone.

The supply region for carbonaceous materials may terminate in the heating zone. Moreover, a supply means for the carbonaceous materials may also terminate in the reaction zone.

BRIEF DESCRIPTION OF THE DRAWINGS

The invention shall now be explained in more detail with reference to embodiments taken in conjunction with the drawing in which.

DETAILED DESCRIPTION

Figure 1:
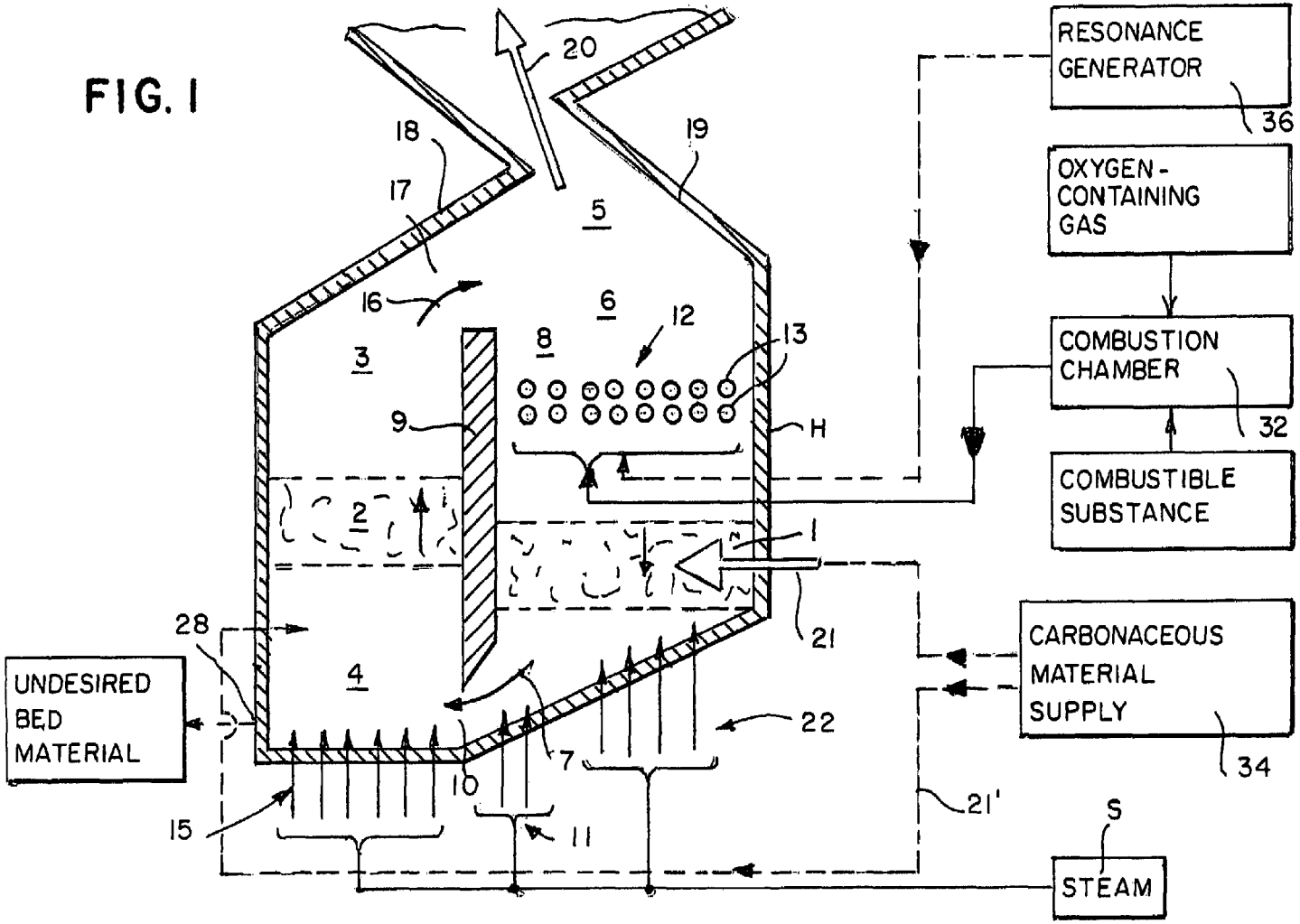
FIG. 1 is a cross section through an embodiment of the apparatus of the invention, where the means for separating the gases from the solid particles comprises baffles.

The embodiment of the apparatus of the invention as shown in FIG. 1 comprises a housing H having a chamber containing reaction zone 3 in which carbonaceous materials are gasified. The carbonaceous materials are positioned in an ascending fluidized bed 2 which is produced with the help of fluidizing means 4 in the reaction zone 3. The fluidizing means 4 provided in the lower area of the reaction zone 3 may e.g. be an open or closed nozzle bottom through which the fluidizing medium steam is blown into the zone. The steam may be mixed with gases. The first nozzle bottom 15 defines the reaction zone 3 in which the fluidized bed 2 is formed. Next to or below the nozzle bottom 15, there is provided an outlet 28 from which e.g. bed material, undesired materials arising from the fuel, ash and non-reacted fuel components cm be withdrawn. Steam may be injured into the outlet, said steam facilitating a withdrawal on the one hand and ensuring a post-reaction of remaining constituents of the fuel on the other hand. Furthermore, the illustrated embodiment comprises a heating zone 6 which is separated from the reaction zone 3 by a device 9. During operation of the reactor, a descending bed 1 of solid particles is formed in the heating zone 6. The lower portion of the heating zone 6 may have disposed therein a second nozzle bottom 22 for the inflow of steam, the steam loosening or slightly fluidizing the bed material of the heating zone for improving transportation of the material. Arranged above the heating zone 6 is the separating and discharging means 5, as will be described in greater detail below.

As shown in FIG. 1, a means 8 for indirectly supplying heat is arranged in the heating zone 6. Said heat supply means 8 may e.g. be composed of one or several heat exchangers. It is clear that the present invention is not limited to the special arrangement of the heat exchanger 12 shown in FIG. 1, but other arrangements are also possible, e.g. on the wall of the heating zone 6. Moreover, instead of the illustrated tubular heat exchange 12, a planar heat exchanger may be used that is e.g. integrated into the wall of the heating zone 6.

The heat exchanger 12 provided in the heating zone may partly consist of resonant tubes 13 in which the heating medium flows in pulsating fashion into the heating zone 6 upon heat emission. The resonant tubes 13 are connected to a combustion chamber (not shown) or another resonance generator for generating the resonant oscillation. The heating medium is directly heated by combustion of a combustible substance with oxygen-containing gas.

As can be seen in FIG. 1, the solid particles are thus heated separately with respect to the gasification taking place in the reaction chamber 3. Due to the weak fluidization of the heating zone, a slowly descending bed 1 is formed in said zone, whereas due to the strong fluidization of the reaction zone 3 a rapidly ascending fluidized bed 2 is formed in said zone. The arrangement of the heat exchanger 12 in the slowly descending bed 1 reduces the great mechanical wear of the heat exchanger that has so far been observed in the prior art. Moreover, the heat exchanger 12 in the heating zone is subjected to less corrosive effects than in the reaction zone 6. This means that the reactor has a longer service life.

The heating zone 6 is connected to the reaction zone 3 via a first transfer passage means 7 with the help of which the solid particles heated in the heating zone 6 are transferred into the reaction zone 3. As shown in FIG. 1, said means 7 is shaped as a wall opening or passage 10. Said means 7, however, may e.g. also be designed as a pipe. For promoting the transportation of the heated solid particles from the heating zone 6 into the reaction zone 3, the first transfer passage means 7 for transferring the heated solid particles may comprise a third nozzle bottom 11. With the help of said third nozzle bottom 11 it is possible to loosen or slightly fluidize the solid particles. The first nozzle bottom 15 used for producing the ascending fluidized bed 2 may be used as the nozzle bottom 11. Attention must here paid that the fluidizing action is more pronounced in the reaction zone 3 than in the heating zone 6.

For circulating the solid particles, a second fusser passage means 16 is provided in the upper area of the reaction zone 3 for returning the solid particles from the reaction zone 3 into the heating zone 6. As shown in FIG. 1, said means 16 may be a wall opening 17. It is also possible to design said second transfer passage means 16 as a pipe. The separating and discharging means 5 for separating the gases produced during gasification from the solid particles and for discharging said gases are baffles 18 and 19 in the embodiment shown in FIG. 1. The baffles 18 and 19 effect a strong deflection of the flow which cannot be followed by the solid particles. Gas flow ad solid particle flow are thus separated at the baffles. The gas flow is discharged via the gas path 20 by which the baffles 18 and 19 are separated. The solid particle flow showers into the heating zone 6 positioned below the baffles 18 and 19.

In the embodiment shown in FIG. 1, a feed means 21 for carbonaceous materials from the supply 34 thereof terminates in the heating zone 6. The fuel can either be pressed into said zone in the area of bed 1 or discharged from above onto bed 1. Moreover, it is possible to provide a further feed means 21' which terminates in the reaction zone 3.

Figure 2:
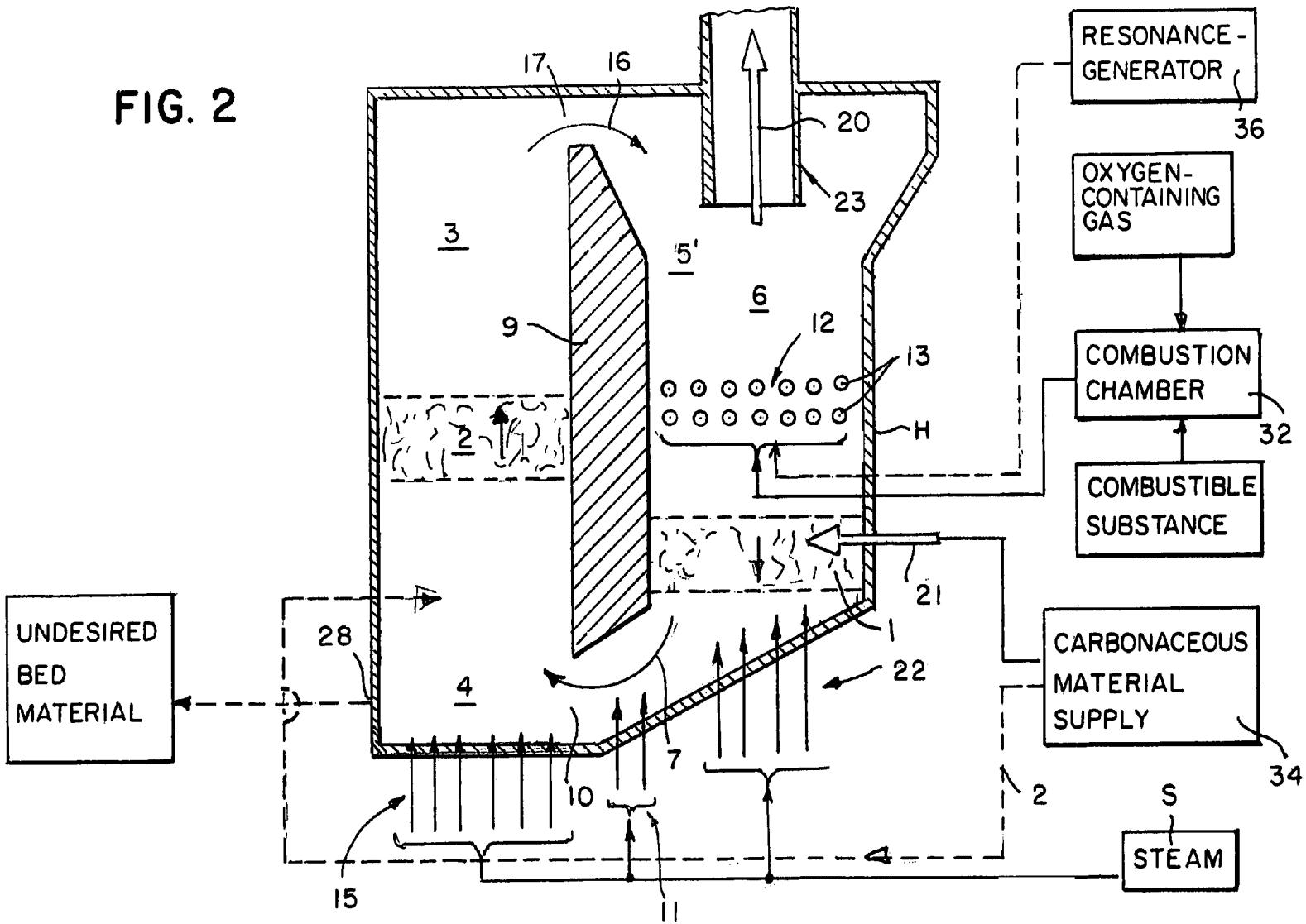
FIG. 2 is a cross section though another embodiment of the apparatus of the invention, where the means for separating the gases from the solid particles is a cyclone.

In the embodiment shown in FIG. 2, the bed material is separated by a cyclone separating and discharging means 5' from the gas flow and fed again via the descending bed 1 to the lower portion of the ascending bed 2. In this instance the gas flow passes via outlet pipe 23 in tangential fashion from the separating and discharging means 5' which is designed as a cyclone.

The invention claimed is:

1. A method for obtaining combustion gases of high calorific value, comprising:

(a) introducing carbonaceous materials (21) into a first relatively slowly descending bed (1) of indirectly heated solid particles;

(b) supplying the carbonaceous materials, the solid particles and a gaseous gasifying agent to a second relatively rapidly ascending fluidized bed (2) in which substantially the greatest part of the carbonaceous materials are allothermically gasified; and (c) separating the gases thus produced from the solid particles.

2. The method according to claim 1, and further including loosening said first descending bed (1) by injecting a gas therein (22).

3. The method according to claim 1, and further including indirectly heating said first descending bed (1) by means of a heat exchanger (12) having a heating medium flowing therethrough.

4. The method according to claim 3, wherein said heating medium is supplied in a pulsating manner to the heat exchanger means in said first descending bed (1).

5. The method according to claim 1, amid further including pressurizing said second ascending bed during the gasification process.

6. The method according to claim 1, characterized in that said gasification process takes place under atmospheric conditions.

7. The method according to claim 1, characterized in that said carbonaceous materials consist of liquid, paste-like or solid materials, in particular of coke, crude oil, biomass or waste materials.

8. The method according to claim 1, characterized in that said gasifying agent is steam.

9. The method for producing combustion gases of high calorific value, comprising:

(a) providing in a vertical heating zone (6) a descending fluidized bed (1) of non-carbonaceous solid particles;

(b) indirectly heating the non-carbonaceous solid particles by heating means (32) arranged externally of said fluidized bed;

(c) transferring the heated solid particles from the bottom of said heating zone to the bottom of a vertical reaction zone (3) having uppcr and lower ends; (d) supplying carbonaceous material (34) to at least one of said heating and reaction zones;

(d) supplying carbonaceous material (34) to at least one of said heating and reaction zones;

(e) allothermically gasifying substantially the greatest part of the carbonaceous material in a relatively rapidly upwardly ascending fluidized bed (2) of said heated solid particles arranged in said reaction zone.

(f) transferring the gasified solid particles from the upper end of said reaction zone to a separating and discharging zone (5) arranged above said heating zone;

(g) separating the combustion gases from the gasified solid particles;

(h) discharging the combustion gases upwardly from said separating and discharging zone; and (i) returning said non-carbonaceous solid particles downwardly to the upper end of said heating zone.

* * * * *